US005316515A

United States Patent [19]

Hyman et al.

[11] Patent Number: 5,316,515

[45] Date of Patent: May 31, 1994

[54] WAIST ATTACHING HOBBY HORSE

[75] Inventors: Greg Hyman, Pound Ridge, N.Y.; Lawrence Reiner, Ft. Lee, N.J.; Martin J. Caveza, Redondo Beach; Roger A. Newbold, Garden Grove, both of Calif.

[73] Assignee: Mattel, Inc., El Segundo, Calif.

[21] Appl. No.: 930,579

[22] Filed: Aug. 17, 1992

[51] Int. Cl.[5] ..... A63H 33/00

[52] U.S. Cl. ..... 446/28; 446/26; 446/397

[58] Field of Search ..... 446/28, 29, 302, 303, 446/313, 330, 351, 359, 361, 369, 397

[56] References Cited

U.S. PATENT DOCUMENTS

| | | | |
|---|---|---|---|
| D. 177,948 | 6/1956 | Smith | 446/28 |
| 1,914,732 | 6/1933 | Breault | 446/28 |
| 2,100,245 | 11/1937 | Fagan | 446/28 |
| 2,264,214 | 11/1941 | Lawrence | 446/28 |
| 2,888,263 | 5/1959 | Ruhmann et al. . | |
| 2,915,312 | 12/1959 | Barthel . | |
| 2,940,755 | 6/1960 | Pouder . | |
| 3,169,764 | 2/1965 | Royce . | |
| 3,224,762 | 12/1965 | Strader . | |
| 3,920,239 | 11/1975 | White . | |
| 4,333,642 | 6/1982 | Adams . | |
| 5,000,712 | 3/1991 | Curry, Sr. . | |
| 5,074,820 | 12/1991 | Nakayama . | |

FOREIGN PATENT DOCUMENTS 1371924 12/1964 France .

*Primary Examiner*—Robert A. Hafer
*Assistant Examiner*—Sam Rimell
*Attorney, Agent, or Firm*—Roy A. Ekstrand

[57] ABSTRACT

A hobby horse includes a neck and head portion secured to the user's waist by a belt attachment. A rein switch is supported within the head interior and is coupled to each end of a closed rein set and is responsive to pulling action upon the reins. A motion sensing switch is supported within the head portion of the hobby horse and responds to motion and changes of motion of the child user and hobby horse. A pair of pressure sensitive switches are disposed proximate the forehead and mouth portions of the hobby horse and respond to simulated feeding and petting actions on the part of the user. A sound producing circuit includes a battery power system, a speaker and a sound sensitizing circuit operatively coupled to the range switch, the motion switch, the forehead switch, and the mouth switch to provide a plurality of sound outputs responsive to play activities sensed by the switches. The rein sensing switch is resistant to overstressing by the child user in pulling upon the reins.

9 Claims, 2 Drawing Sheets

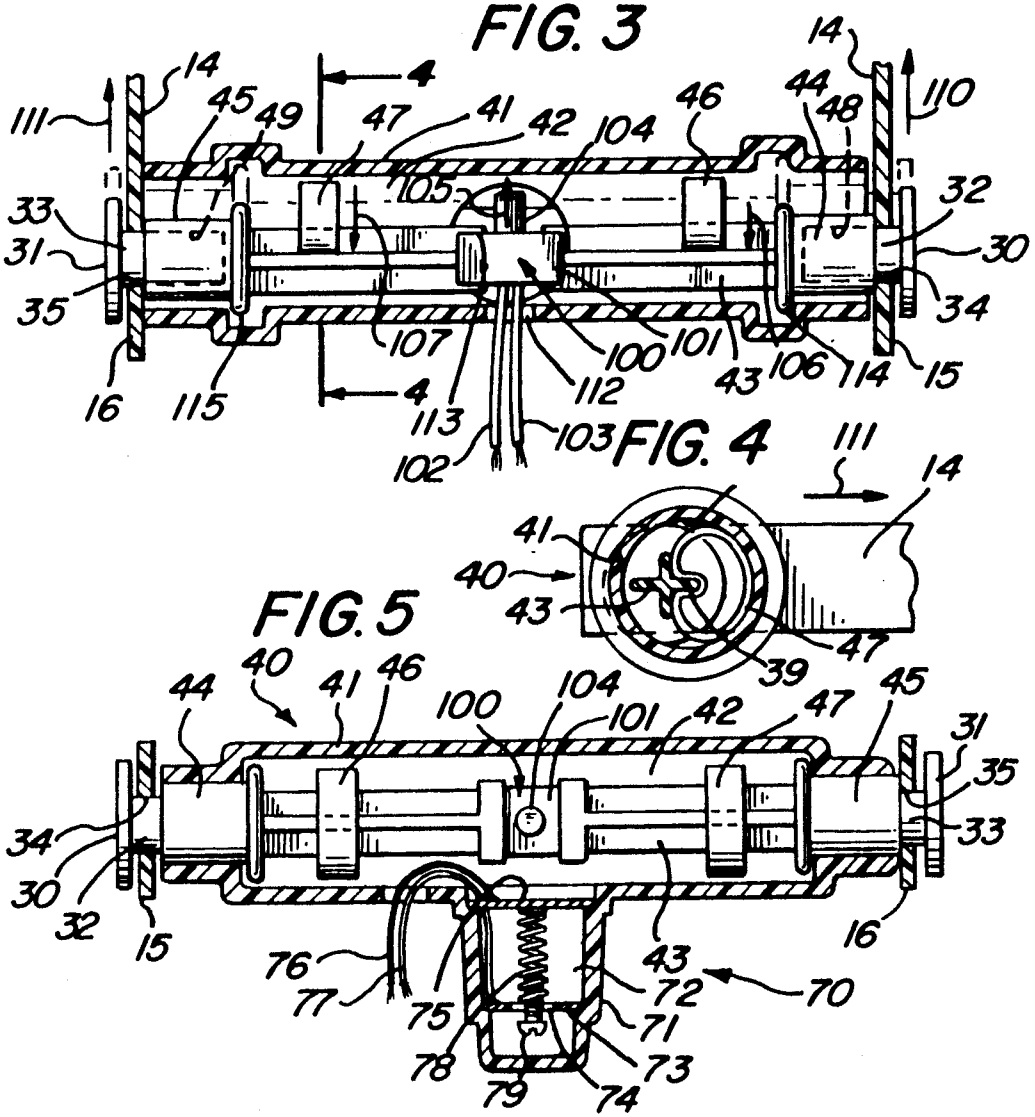
FIG. 3
FIG. 4
FIG. 5
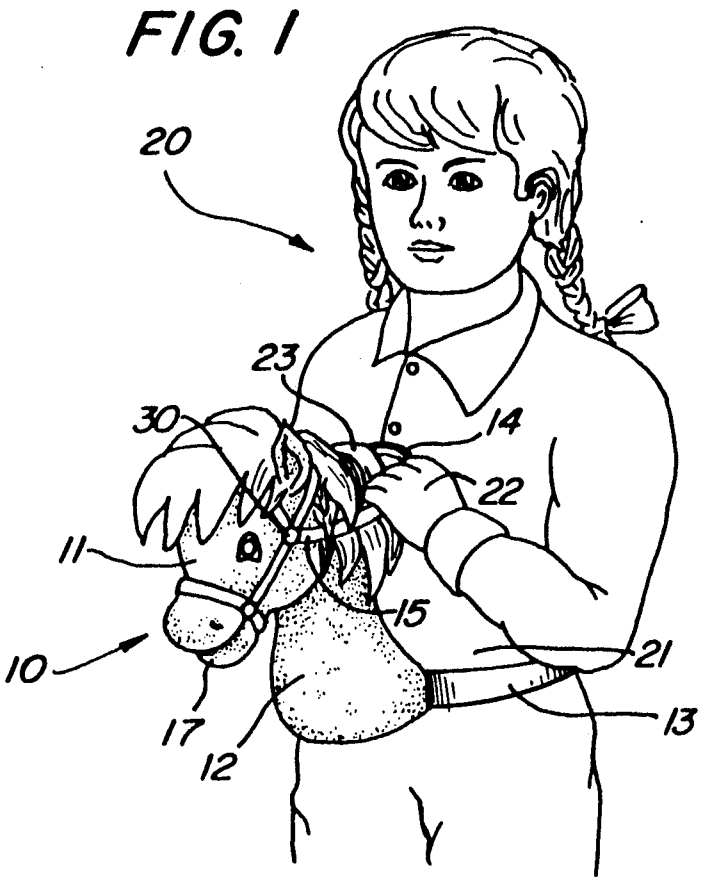
FIG. 1

10
12
13
14
15
17
18
19
24
25
26
27
28
40
50
60
70
80
81
82
83
84
85
86
87
3
5

WAIST ATTACHING HOBBY HORSE

FIELD OF THE INVENTION

This invention relates generally to hobby horse toys and particularly to those adapted to be worn about the user's waist.

BACKGROUND OF THE INVENTION

One of the most pervasive toys provided to young children through the years is that generally referred to as a hobby horse toy which derives its name from the use of a frontal member which replicates the upper neck and head of a horse or pony. Such hobby toys originally provided a horse's upper neck and head secured to a long stick or rod having a rolling wheel secured to the bottom end thereof. The user "rode" the hobby horse by extending the head and neck portion forwardly and the elongated rod downwardly between the user's legs to rest upon the rolling wheel. Generally simulated reins secured to the horse head provided convenient holding means. Due to the popularity of hobby horses, additional variants have been developed which have included riding toys formed to resemble a horse or pony and having a riding seat or saddle. Additional hobby horse structures have been provided which attach to the user's thigh for bouncing a young child and waist attaching hobby horses secured directly to the user's waist or supported by shoulder's harnesses.

Examples of the foregoing hobby horses are found in a number of issued patents. For example, U.S. Pat. No. 3,224,762 issued to Strader sets forth a HOBBY HORSE having a simulated horse head supported by a waist harness or belt. A mainframe bar extends downwardly from the waist belt between the user's legs in a generally U-shaped form to stabilize the hobby horse and free the user's hand for play.

U.S. Pat. No. 3,920,239 issued to White sets forth a HOBBY HORSE adapted to be worn about the waist of a child. The horse comprises a forward section having a head and adjoining fore quarters part, a hind section comprising the rump and adjoining part and elastic sides joining the fore and hind sections to provide waist attachment.

U.S. Pat. No. 4,333,642 issued to Adams sets forth a TOY having a toy horse supported on the user by a shoulder harness assembly. The horse includes a hollow body member having a central opening formed in the upper back portion thereof. The head is pivotally secured to the body portion and coupled to a linkage mechanism extending through the horse body to provide head movement by the user.

U.S. Pat. No. 2,888,263 issued to Ruhmann, et al. sets forth a KNEE-RIDING HORSE having a simulated horse head and saddle portion adapted to be worn by the user above the knee on the lower thigh. In its intended use, the user may place a young child upon the simulated horse supported by the user's thigh and knee and provide an entertaining bouncing activity for the young child.

U.S. Pat. No. 5,000,712 issued to Curry, Sr. sets forth a RIDING TOY having a knee riding type toy horse similar to that set forth in U.S. Pat. No. 2,888,263 which provides a substantially more padded saddle and body portion for the child to rest upon during the play activity.

French Patent 1,371,924 issued to Hemar sets forth a hobby horse toy having forward and rear portions coupled by a harness and belt apparatus to provide enclosure about the child user's waist and support using a shoulder harness.

U.S. Pat. No. 2,940,755 issued to Pouder sets forth a TOY HORSE having an elongated frame member supporting a simulated horse's head at one end and a pair of rolling wheels at the remaining end A pair of tines and cam apparatus are supported at the lower end and actuated by the rolling of the wheels.

U.S. Pat. No. 3,169,764 issued to Royce sets forth a TOY DEVICE having an elongated frame member supporting a simulated horse's head at the upper portion thereof and a rolling wheel at the lower portion thereof. The horse's lower jaw is pivotally secured and coupled to a movable handle by a linkage member to provide jaw actuation as the handle is moved.

U.S. Pat. No. 5,074,820 issued to Nakayama sets forth a STUFFED VIBRATING SOUNDING SITTING TOY having a stuffed toy body such as a horse comprising a main switch turned on in response to a load applied externally, a vibrator actuated when the main switch is turned on to vibrate at least a part of the body of the stuffed toy and a sound generator for producing accompanying sound.

U.S. Pat. No. 2,915,312 issued to Barthel sets forth a SOUND PRODUCING MECHANISM FOR A CHILD'S AMUSEMENT DEVICE having a support frame including upwardly extending support members between which a simulated horse is resiliently suspended by a plurality of spring members. Sound producing means are operatively coupled to the spring suspended horse body to produce sounds as the body is moved by the rider.

U.S. Pat. No. 4,157,826 issued to Sims, et al. sets forth a TOY ASSEMBLY WITH SOUND DEVICE which may be combined with a toy hobby horse. A whinny or neigh sound may be produced by child operated movement of the reins to stress and subsequently release a weight loaded spring lever within the horse's head. A coil spring is positioned to contact the spring lever for generation of the noise. A one-way stop mechanism retains the weighted spring lever until sufficient stress is developed.

While the foregoing described representative prior art devices have in many instances provided amusing and enjoyable hobby horse toys, there remains nonetheless a continuing need in the art for evermore improved, entertaining and amusing hobby horse toys.

SUMMARY OF THE INVENTION

Accordingly, it is a general object of the present invention to provide an improved hobby horse toy. It is a more particular object of the present invention to provide an improved hobby horse toy which is worn about the user's waist and which provides an interesting and enjoyable play pattern for the user.

In accordance with the present invention, there is provided a waist supported play animal comprises: an animal head and neck portion; a belt coupled to the neck portion for user waist attachment; a rein switch supported within the head having rein attachment means on each side thereof; a rein having end portions coupled to the rein attachment means; a motion switch supported within the head portion; a plurality of pressure responsive switches disposed within the head portion and actuatable by user touch and manipulation of the head in proximity thereto; and sound means, having means for producing a plurality of stored audible sounds, coupled to the rein switch, the motion switch and the plurality of pressure responsive switches to select one or more of the sounds in response to actuation thereof.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a front perspective view of a waist attaching hobby horse constructed in accordance with the present invention worn by a typical child user;

FIG. 3 sets forth a section view of a portion of the present invention hobby horse taken along section lines 3—3 in FIG. 2;

FIG. 4 sets forth a section view of a portion of the present invention hobby horse taken along section lines 4—4 in FIG. 3 and FIG. 5 sets forth a section view of a portion of the present invention hobby horse taken along section lines 5—5 in FIG. 2.

DESCRIPTION OF THE PREFERRED EMBODIMENT

Figure 2:
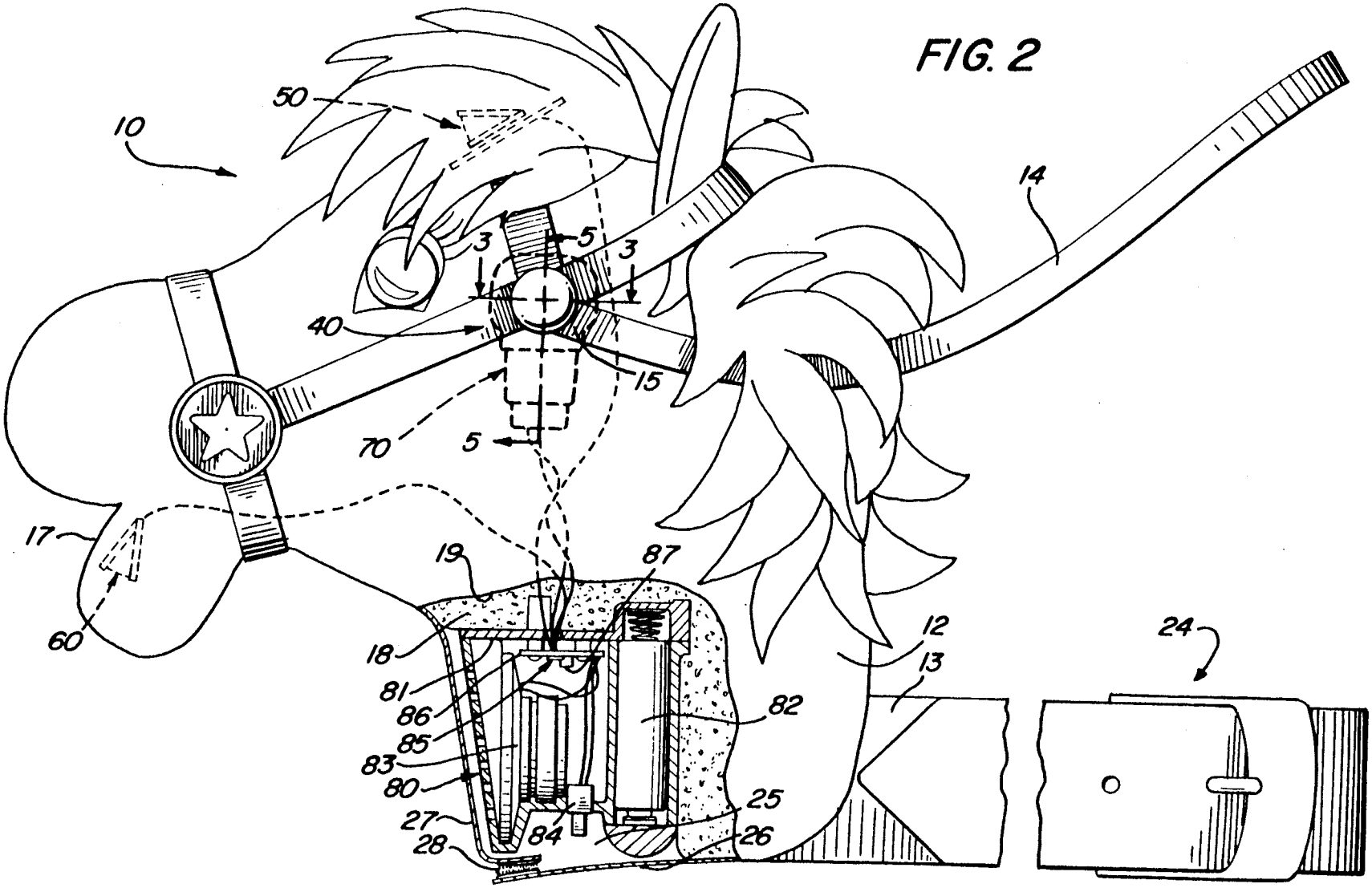
FIG. 2 sets forth a partially sectioned side elevation view of the present invention hobby horse.

FIG. 1 sets forth a front perspective view of a hobby horse constructed in accordance with the present invention and generally referenced by numeral 10 worn by a typical child user generally referenced by numeral 20. Hobby horse 10 includes a head portion 11 supported by an upwardly extending neck portion 12. A belt 13 is secured to neck portion 12. Head 11 further supports a pair of movable rein attachments 30 and 31 (the latter seen in FIG. 3). A closed loop set of reins 14 defines end portions 15 and 16 secured respectively to rein attachments 30 and 31 (the latter seen in FIG. 3)

User 20 secures hobby horse 10 by encircling waist 21 with belt 13 and securely clasping belt 13 utilizing the buckle clasp set forth below in FIG. 2. Thereafter, hands 22 and 23 of user 20 may grasp reins 14 and in accordance with the operation set forth below in greater detail manipulate rein attachments 30 and 31 to carry forward a hobby horse play pattern. In its preferred form, head 11 and neck 12 of hobby horse 10 are fabricated of a soft padded plush material and present a fanciful horse head depiction. It will be apparent to those skilled in the art, however, that head 11 and neck 12 may, if desired, be fabricated in the shape of other animals without departing from the spirit and scope of the present invention.

Thus, in the anticipated play pattern, user 20 having attached hobby horse 10 in the manner shown and grasping reins 14 is able to carry forward a variety of play activities. As is set forth below in greater detail, these activities include controlling the various sounds produced by hobby horse 10 in response to movements of reins 14, heading of head 11, simulated feeding of mouth 17, and response to overall motion of hobby horse 10 as user 20 moves about. During all the various play patterns and motion activities, hobby horse 10 remains securely attached to the user's waist through belt 13 freeing the user's hand entirely.

FIG. 2 sets forth a partially sectioned side view of hobby horse 10. As described above, hobby horse 10 includes a head 11 supported by a neck 12 which in turn is secured to a belt 13. Belt 13 includes a conventional buckle and clasp 24 to provide attachment and size adjustment. Head Il and neck 12 are preferably formed of a soft plush construction and thus include a padded body 18 upon which a plush covering 19 is disposed in accordance with conventional fabrication techniques. Head 11 further supports a rein switch 40 extending transversely through head 11 and set forth below in FIGS. 3 through 5 in greater detail. Rein switch 40 further includes a pair of rein attachments 30 and 31 (the latter seen in FIG. 3) which are secured to ends 15 and 16 respectively of rein 14. A motion switch 70 is secured to rein switch 4 and fabricated in accordance with the structure set forth below in FIG. 5 in greater detail. In its preferred form, rein switch 40 and motion switch 70 are supported within a common housing and fitted securely within padding 18 of head 11. Head 11 further supports a pressure actuated petting switch 50 positioned as shown in dashed line representation and a similar pressure actuated feeding switch 60 positioned near mouth 17 and shown in dashed line representation.

Neck 12 defines an interior cavity 25 having a pair of flexible outer covering members 26 and 27 securable by a hook and loop fabric attachment segment 28. A sound producing circuit 80 includes a housing 81 which receives and supports a plurality of conventional batteries 82 and a conventional speaker 83. Sound producing circuit 80 further includes a downwardly extending on/off switch 84 supported at the lower end of housing 81 and an internally supported sound synthesizing circuit 85. Synthesizing circuit 85 is constructed in accordance with conventional fabrication techniques and includes a printed circuit board 86 which supports a plurality of conventional electronic circuit components 87. Sound synthesizing circuit 85 comprises a conventional sound producing circuit within which a plurality of audible sound messages are stored which are then placed through speaker 83 in response to predetermined input signals provided by rein switch 40, petting switch 50, feeding switch 60 and motion switch 70 to provide the accompanying sound inputs described below in greater detail. It will be apparent to those skilled in the art that a variety of sound synthesizing circuits may be utilized for sound synthesizer 85 without departing from the spirit and scope of the present invention. It should be further understood by those skilled in the art that the power coupling between batteries 82 and circuit 85 is not shown in Figure but is carried forward nonetheless in accordance with conventional fabrication techniques.

In operation, the user attaches hobby horse 10 to the user's waist in the manner shown in FIG. 1 utilizing belt 13 and buckle and clasp 24. Play is initiated as the child user moves about disturbing motion switch 70 and producing an electrical signal by means set forth below in greater detail which is communicated to sound synthesizing circuit 85 causing a selected sound pattern to be produced. One of the anticipated sound patterns consistent with the horse-like appearance of hobby horse 10 is the producing of a whinney and galloping sound combination typical of the user's expectation of sounds made by horses. As the galloping and whinney sounds continue, the user may pull backwardly upon reins 14 so as to operate rein switch 40 in the manner set forth below and produce an additional electrical signal which when received by sound synthesizing circuit 85 produces a sound pattern consistent with the user's expectation of stopping hobby horse 10. Thus, in its preferred operation, sound circuit 85 responds to signals from rein switch 40 by interrupting the galloping sounds and producing a sound output corresponding to stopping such as "whoa partner" and a synthesized snorting sound.

Thus, as the child moves about activating motion switch 70 and manipulating reins 14 to actuate rein switch 40 an interesting set of sound combinations consistent with and related to the user's activity is produced. This play pattern may be carried on virtually endlessly by the user to provide substantial amusement.

In addition to sound effects produced by manipulation of reins 14 and motion switch 70, horse 10 receives further inputs from petting switch 50 and feeding switch 60. Thus, as the user applies petting pressure to the upper forward portion of head 11 of horse 10, petting switch 50 is actuated producing signal inputs for sound synthesizing circuit 85 which cause sound synthesizing circuit 85 to produce a randomly selected one of a plurality of appropriate sound outputs. Similarly, in the event the user manipulates mouth 17 of hobby horse 10, feeding switch 60 is actuated producing a signal input to sound synthesizer 85 which causes sound circuit 85 to produce a selected one of a variety of sound outputs. Because feeding switch 60 is positioned proximate mouth 17, it is anticipated that the play pattern resulting in actuation of feeding switch 60 corresponds to feeding activities. Accordingly, in its preferred form, sound synthesizer 85 responds to actuation of feeding switch 60 by producing theme related sound signals such as "yummy" together with a chewing sound effect or the like.

It will be apparent to those skilled in the art that the above-described switch actuation and thematically related sound outputs provides an entertaining and amusing hobby horse for the child user. A still further amusing and entertaining play pattern is developed however due to the use of sound synthesizer 85 in response to a plurality of simultaneous switch actuations or various sequences of switch inputs. For example, sound circuit 85 may respond differently to actuation of rein switch 40 depending upon the condition of motion switch 70. Similarly, petting switch 50 may produce different sound responses when accompanied by actuation of feeding switch 60.

FIG. 3 sets forth a section view of rein switch 40 taken along section lines 3—3 in FIG. 2. Rein switch 40 includes hollow switch housing 41 defining an interior cavity 42. An elongated cruciform cross-sectioned switch bar 43 defines a pair of outwardly facing generally cylindrical end bearings 44 and 45 having outwardly facing closed end passages 48 and 49 formed therein respectively. A pair of rein attachments 30 and 31 define a pair of inwardly extending cylindrical boss members 32 and 33 respectively. Boss members 32 and 33 extend through apertures 34 and 35 respectively formed in end portions 15 and 16 of rein 15 and are received within passages 48 and 49 of end bearings 44 and 45 respectively. Thus, rein attachments 30 and 31 provide secure coupling between ends 15 and 16 of reins 14 and the outer portions of switch bar 43. Switch bar 43 is resiliently supported within interior cavity 42 by a pair of springs 46 and 47, the structure of which is better seen in FIG. 4 below. Suffice it to note here, however, that springs 46 and 47 are securely coupled to cruciform switch bar 43 proximate end bearings 44 and 45 and are operative to urge cruciform switch bar 43 forwardly in the directions indicated by arrow 106 and 107.

A microswitch 100, constructed in accordance with conventional fabrication techniques defines a housing 101 received within a rectangular aperture 113 formed at the center of switch bar 43. Microswitch 100 further includes an outwardly extending switch button 104 and a pair of connecting wires 102 and 103 which pass through aperture 112 of switch housing 41 and are coupled to sound synthesizing circuit 85 (seen in FIG. 2).

In the position shown in FIG. 3, rein switch 40 is essentially inactive and switch bar 43 is positioned within interior cavity 42 in response to the spring forces of springs 46 and 47. Thus, in this position, microswitch 100 is not actuated and no signals are provided to the sound synthesizing circuit. In its preferred form, rein switch 40 responds to the pulling action of the user imposed upon either of ends 15 or 16 or upon ends 15 and 16 concurrently. Thus, in the event the user pulls on end 15 in the direction indicated by arrow 110, a substantially greater force is applied to spring 46 causing spring 46 be compressed and permitting end bearing 44 to move correspondingly rearward in the direction indicated by arrow 110. Because the pulling upon rein 14 is uneven, switch bar 43 pivots about spring 47 bringing button 104 into contact with the rear wall of switch housing 41. As the pulling continues, the force upon button 104 becomes sufficient to actuate switch 100. Conversely, in the event the user pulls upon the opposite side of rein 14 so as to draw end 16 rearwardly in the direction indicated by arrow 111, spring 147 is compressed and switch bar 43 pivots generally about spring 46 once again bringing button 104 into contact with the rear portion of switch housing 41 and actuating switch 100. In response to a generally even pulling force applied to both sides of rein 14, ends 15 and 16 are drawn generally simultaneously rearward in the directions indicated by arrows 110 and 111 which compresses springs 46 and 47 simultaneously and presses button 104 against the rear surface of housing 41.

It should be noted that the structure of rein switch 40 is fabricated to provide protection against overstressing of switch 100 in that switch bar 43 includes a pair of outwardly extending flange members 114 and 115 which as is seen in dashed-line representation in FIG. 3 are brought into contact with the rear portion of switch housing 41 and provide a travel limit for rearward motion of switch bar 43 which protects microswitch 100. This is particularly advantageous due to the tendency of younger children to pull on reins 14 too vigorously during the excitement of play activities.

FIG. 4 sets forth a section view of rein switch 40 taken along section lines 4—4 in FIG. 3. Rein switch 40 defines a generally cylindrical switch housing 41 having an interior cavity 42 formed therein. A cruciform cross-sectioned switch bar 43 is received within interior cavity 42 and supported by a pair of springs 46 and 47 (the former seen in FIG. 3). Ring 14 defines an end portion 16 coupled to switch bar 43 in the manner set forth above. Spring 47 defines a generally oval-shape spring member having an inwardly extending U-shaped clasped portion 39. Clasp portion 39 receives and grasps the rearwardly extending web of cruciform crossbar 43 in a secure attachment. Thus, spring 47 is firmly secured to switch bar 43 and provides a biasing or spring force which resists rearward motion of switch bar 43 in the direction indicated by arrow 111. Because spring 46 is securely attached to switch bar 43, the rough vibratory motions produced during the typical child play pattern are compensated for due to the tendency of spring 47 to move with switch bar 43 in virtually all directions.

FIG. 5 sets forth a section view of the combination of rein switch 40 and motion switch 70 taken along section lines 5—5 in FIG. 2. As described above, rein switch 40 includes an elongated housing 41 defining an interior cavity 42. An elongated cruciform shaped switch bar 43 is supported within housing 41 by a pair of end bearings 44 and 45. A pair of attachments 30 and 31 secure end portions 15 and 16 respectively of reins 14 to switch bar 43. A microswitch 100 having a rearwardly extending button 104 and a housing 101 is secured to the center portion of switch bar 43. A pair of springs 46 and 47 are coupled to switch bar 43 biasing switch bar 43 forwardly as described above. Motion switch 70 defines a housing 71 defining an interior cavity 72 extending generally downwardly from housing 41 of switch 40. A fixed contact 75 is supported within the upper portion of interior cavity 72 and coupled to a connecting wire 76. An annular contact 73 having an aperture defined therein is fixedly supported within the lower portion of interior cavity 72 and is coupled to a connecting wire 77. Motion switch 70 further includes an elongated spring 78 having one end thereof secured to the center portion of fixed contact 75 and the remaining end thereof extending downwardly through aperture 74. A metal weight 79 is secured to the lower end of spring 78.

In operation, in the absence of motion, spring 78 and weight 79 extend downwardly in the position shown in FIG. 5 and, as a result, spring 78 extends through aperture 74 and avoids contact with annular contact 73. Once motion is occurring, however, weight 79 causes spring 78 to move about in a flexing action shown by the arrows in FIG. 5. If the motion imposed upon motion switch 70 by movement of hobby horse 10 is sufficiently abrupt or of sufficient speed, spring 78 flexes a sufficient distance to permit weight 79 and spring 78 to contact the interior surface of annular contact 73 completing the circuit of motion switch 70 and communicating an electrical signal to sound synthesizing circuit 85 (seen in FIG. 1) via connecting wires 76 and 77.

What has been shown is a novel and exciting hobby horse toy which may be worn about the user's waist in a manner freeing the user's hand for manipulation of the hobby horse's reins or petting action upon the outer surface of the hobby horse head and the like. The hobby horse shown provides pressure sensitive switches in the forehead and mouth portions of the hobby horse head to communicate additional information to a sound producing circuit within the neck portion of the hobby horse. A rein switch mechanism responds to rein actuation and pulling to provide further information to the sound producing circuit. A motion sensing switch permits the sound producing circuit to respond to the presence or absence of play motion by the child user.

While particular embodiments of the invention have bee shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A waist supported play animal comprising:
an animal head and neck portion;
a belt coupled to said neck portion for user waist attachment;
a rein switch supported within said head having rein attachment means on each side thereof, said rein switch including;
an elongated housing having an elongated interior cavity formed therein;
an elongated switch bar having opposed ends and having said rein attachment means supported at said opposed ends;
spring support means coupled to said switch bar urging said switch bar forwardly within said interior cavity;
a switch supported by said switch bar and having a rearwardly extending actuator; and
limit means for limiting the rearward travel of said switch bar;
a rein having end portions coupled to said rein attachment means;
a motion switch supported within said head portion;
a plurality of pressure responsive switches disposed within said head portion and actuatable by user touch and manipulation of said head in proximity thereto; and
sound means, having means for producing a plurality of stored audible sounds, coupled to said rein switch, said motion switch and said plurality of pressure responsive switches to select one or more of said sounds in response to actuation thereof.

2. A waist supported play animal as set forth in claim 1 wherein said switch bar includes bearings at said opposed ends.

3. A waist supported play animal as set forth in claim 2 wherein said spring support means include a pair of springs coupled to said switch bar proximate said bearings.

4. A waist supported play animal as set forth in claim 3 wherein said switch bar defines a rearwardly extending rib and wherein said springs each define a generally oval shape having an inwardly extending U-shaped clasp formed therein receiving and clasping said rib.

5. A waist supported play animal as set forth in claim 1 wherein said head portion defines a forehead and a mouth and wherein said plurality of pressure responsive switches are supported proximate said mouth and forehead.

6. A waist supported play animal as set forth in claim 5 wherein said head and neck portions resemble a horse head and horse neck portion respectively.

7. A waist supported play animal as set forth in claim 6 wherein said switch bar includes bearings at said opposed ends.

8. A waist supported play animal as set forth in claim 7 wherein said spring support means include a pair of springs coupled to said switch bar proximate said bearings.

9. A waist supported play animal as set forth in claim 8 wherein said switch bar defines a rearwardly extending rib and wherein said springs each define a generally oval shape having an inwardly extending U-shaped clasp formed therein receiving and clasping said rib.

* * * * *